US005879135A

United States Patent [19]

Kuypers

[11] Patent Number: 5,879,135

[45] **Date of Patent: *Mar. 9, 1999**

[54] MONOLITHIC HIGH VACUUM HOUSING WITH VAPOR BAFFLE AND COOLING FINS

[75] Inventor: Ned R. Kuypers, Los Altos, Calif.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 645,543

[22] Filed: May 10, 1996

[51] Int. Cl.[6] ..... F04F 9/00

[52] U.S. Cl. ..... 417/154

[58] Field of Search ..... 417/154

[56] References Cited

U.S. PATENT DOCUMENTS

| | | | |
|---|---|---|---|
| 4,086,031 | 4/1978 | Kuypers | 417/154 |
| 4,610,603 | 9/1986 | Norman | 417/154 |
| 5,137,429 | 8/1992 | Broadhurst | 417/152 |
| 5,317,900 | 6/1994 | Bergquist | 73/40.7 |

*Primary Examiner*—Charles G. Freay
*Assistant Examiner*—Ehud Gartenberg

[57] ABSTRACT

A housing that defines a high vacuum work environment includes a monolithic member that has one side having a baffle region and a wall region. The baffle region includes at least one angularly contoured evacuation opening that forms a zig-zag flow path from the high vacuum work environment. In the preferred embodiment, each evacuation opening has a chevron-shaped cross section having an outer channel portion that is defined by baffle fins that are parallel or substantially parallel to each other, but at an acute angle relative to the side of the monolithic member. The wall region includes convection cooling fins that are aligned with the baffle fins.

10 Claims, 5 Drawing Sheets

MONOLITHIC HIGH VACUUM HOUSING WITH VAPOR BAFFLE AND COOLING FINS

TECHNICAL FIELD

The invention relates generally to apparatus for high vacuum applications and more particularly to forming a work environment that retards vapor backstreaming from a vapor diffusion pump.

BACKGROUND ART

Mechanical pumps are used in a wide variety of applications for reducing pressure in an enclosed region to approximately 10 milliTorr. However, in some vacuum applications, further reductions in pressure are required. U.S. Pat. No. 4,086,031 to Kuypers, which is assigned to the assignee of the present invention, notes that some analytical instruments, such as gas chromatograph/mass spectrometer instruments, require evacuated environments that exceed the capability of known mechanical pumps. Consequently, a diffusion pump is combined with a mechanical pump to provide a "high-vacuum environment," i.e., a pressure below $10^{-4}$ Torr.

For high vacuum applications, the mechanical pump acts as a "roughing pump" to remove the bulk of the air from a vacuum chamber. A rotating vane, positive displacement pump may be utilized. The diffusion pump then provides further evacuation, with the mechanical pump operating to maintain the backing pressure for the diffusion pump. The conventional diffusion pump operates by use of high speed jets of oil vapor which collide with gas molecules that enter from a vacuum chamber positioned above the diffusion pump. A pool of oil at the bottom of the diffusion pump is rapidly heated to vaporize the oil. A jet of vapor is directed upwardly through a chimney-like assembly and then downwardly and outwardly through one or more nozzles to provide umbrella vapor jets. Air molecules that are struck by the working vapor are pushed downwardly to a region in which the mechanical pump can remove the gas molecules. Thus, the gas molecules are removed by kinetic energy transfer. While the gas molecules are removed, the oil molecules condense on the cooled walls of the diffusion pump. Cooling can be accomplished by directing a flow of air across the exterior walls of the pump or by applying a liquid coolant. The condensed oil molecules are directed back to the pool of oil by gravity return, where re-vaporization allows a continuous cycle of operation.

While oil vapor diffusion pumps have been used to provide low-cost, high-vacuum pumping capability in such applications as scientific instrumentation and production process equipment, these pumps are susceptible to "backstreamed" oil. As previously noted, a diffusion pump may include more than one umbrella, i.e. stage, of supersonic vapor. Oil vapor from the uppermost stage is most susceptible to being undesirably introduced into the vacuum chamber or manifold that is mounted above the diffusion pump.

There are a number of causes of backstreaming. First, collisions between the pumping vapor molecules and the pumped gas molecules invariably project unwanted pumping vapor molecules in an upward direction toward the vacuum chamber or manifold. This effect potentially introduces contamination into the vacuum region and impedes the level of vacuum that can be obtained.

Another major cause of backstreaming is re-evaporation of oil molecules that condense on the walls and/or nozzle surfaces of the diffusion pump, with the re-evaporated molecules being directed toward the vacuum chamber or manifold. While the condensing walls of the pump are cooled to some extent, evaporation does occur.

Backstreaming may also result during startup/shutdown sequences of the diffusion pump system, since the normally supersonic jetstreams collapse and become subsonic. The subsonic streams are more likely to lose molecules to the region that is to be evacuated, than are supersonic streams.

In order to control backstreaming, baffles are mounted between the diffusion pump and the vacuum housing, i.e. the vacuum chamber or manifold. For example, an air-cooled or water-cooled chevron baffle may be introduced between the two components. Such baffles are sometimes referred to as "optically opaque," i.e. a vapor molecule from the diffusion pump is prevented from following a straight-line trajectory into the vacuum housing. Any backstreaming molecules that follow a straight-line trajectory will instead impinge on or collide with a cooled surface of the baffle, condense, and return to the diffusion pump. A chevron baffle is one in which the cross section of a flow path through the baffle has the configuration of a chevron.

What is needed is an apparatus and system that provide an efficient and inexpensive approach to retarding backstreaming from a diffusion pump to a region that is to be evacuated.

SUMMARY OF THE INVENTION

A vacuum system for high vacuum applications includes a housing that integrates the structure for forming a work environment to be evacuated with the structure for retarding backstream contamination. In the preferred embodiment the housing includes a monolithic member having a number of sides, including a side having a wall region which is integral with a baffle region. The exterior of the wall region has a contour that facilitates thermal energy transfer from the baffle region. The baffle region provides angularly contoured evacuation openings that form serpentine flow paths from the high vacuum work environment to the exterior of the housing. When the baffle region is connected to a vacuum source, such as a diffusion pump, the contour of the evacuation openings prevents a straight-line trajectory of molecules into the interior of the housing via the baffle region.

In one embodiment, each angularly contoured evacuation opening through the baffle region has a cross section that has a chevron shape. That is, the baffle region is a chevron baffle. Each of the evacuation openings includes an inner channel portion and an outer channel portion. The inner channel portions of the evacuation openings may be bores through the wall of the monolithic member, while the outer channel portions are formed by raised fins. For the chevron-shaped channels, the fins extend integrally and outwardly at an acute angle relative to the major exterior surface of the side of the housing that includes the wall region and the baffle region. The bores are also at acute angles relative to the major exterior surface, with the two acute angles being selected to provide "optically opaque" evacuation openings, i.e. openings that prevent straight-line trajectory therethrough.

The wall region preferably includes convection cooling fins that project outwardly from the major exterior surface of the side. The cooling fins have lengthwise ends near the baffle region, so that the cooling fins begin in proximity to the baffle region. The metal that forms the monolithic member provides a thermal conduction path from the baffle region to these lengthwise ends. The cooling fins extend in a lengthwise direction away from the baffle region to further the thermal conduction path from that region. Moreover, the cooling fins provide an increased surface area for the convection heat transfer of thermal energy from the baffle region. This facilitates forced-air cooling of the assembly. For a vacuum system that uses a diffusion pump, the structure that defines the angularly contoured evacuation opening should be maintained at a temperature that will cause backstreaming molecules to condense upon contact with a surface of one of the evacuation openings. The single-piece construction of the baffle region and the convection cooling fins establishes an efficient thermal conduction path and allows the use of a single forced-air cooling device, e.g. a fan, to maintain low condensing-surface wall temperatures for the baffle region. Although it is the preferred method, this invention is not limited to forced-air convection cooling, since liquid cooling of the monolithic member sufficiently close to the baffle region (e.g., by connecting water cooling tubes or lines to rails that extend lengthwise along the monolithic member) will provide efficient heat-transfer conduction from the baffle region.

The work environment that is defined by the housing may be a "stand alone" vacuum chamber or may be a chamber of a manifold, such as a manifold for a gas chromatograph/mass spectrometer system. The monolithic member defines the chamber, but a number of sides may be open until panels or flanges are mounted to the monolithic member to complete the housing. Optionally, the side of the housing that includes the baffle region and the raised convection cooling fins of the wall region is a panel member that is mounted to the remainder of the vacuum chamber housing.

While not critical, the system may include a baffle spool that is attached to the baffle region of the housing. The diffusion pump is attached to the bottom of the baffle spool by means of a vacuum seal. The baffle spool encloses the exterior of the baffle region and is shaped to provide a liquid phase "drip-back" path for returning condensed work molecules to the diffusion pump. In the preferred embodiment, this is achieved by using an extended upper portion of a diffusion pump housing, rather than by using the baffle spool.

While the method of fabricating the monolithic member is not critical, a fabrication sequence that is cost efficient includes using metal extrusion techniques to form a chamber frame and an array of parallel fins along one surface of the frame. The fins are at the desired acute angle for forming the outer channel portions of the angularly contoured evacuation openings. The frame is then cut or formed using known machining processes, such as milling or electrochemical/electrical discharge machining. At least some of the fins are segmented to define the baffle fin segments and the convection cooling fin segments. Moreover, material is removed to form the angled bores that are the inner channel portions of the angularly contoured evacuation openings. To facilitate machining, one or more sides of the frame may be removed, but preferably a frame remains for attachment of a panel to the opened side.

An advantage of the invention is that, by integrating the chamber housing with the baffle, an uninterrupted thermal conduction path is established for channeling thermal energy from the baffle region to a cooled region. The manufacturing cost is reduced by providing the single-piece construction. Moreover, the integration of the vacuum housing and the baffle reduces the number of high vacuum seals required to maintain the integrity of the vacuum system. That is, the cost of the sealing arrangement is reduced relative to systems that require high vacuum seals on each side of a separately formed baffle.

BEST MODE FOR CARRYING OUT THE INVENTION

Figure 1:
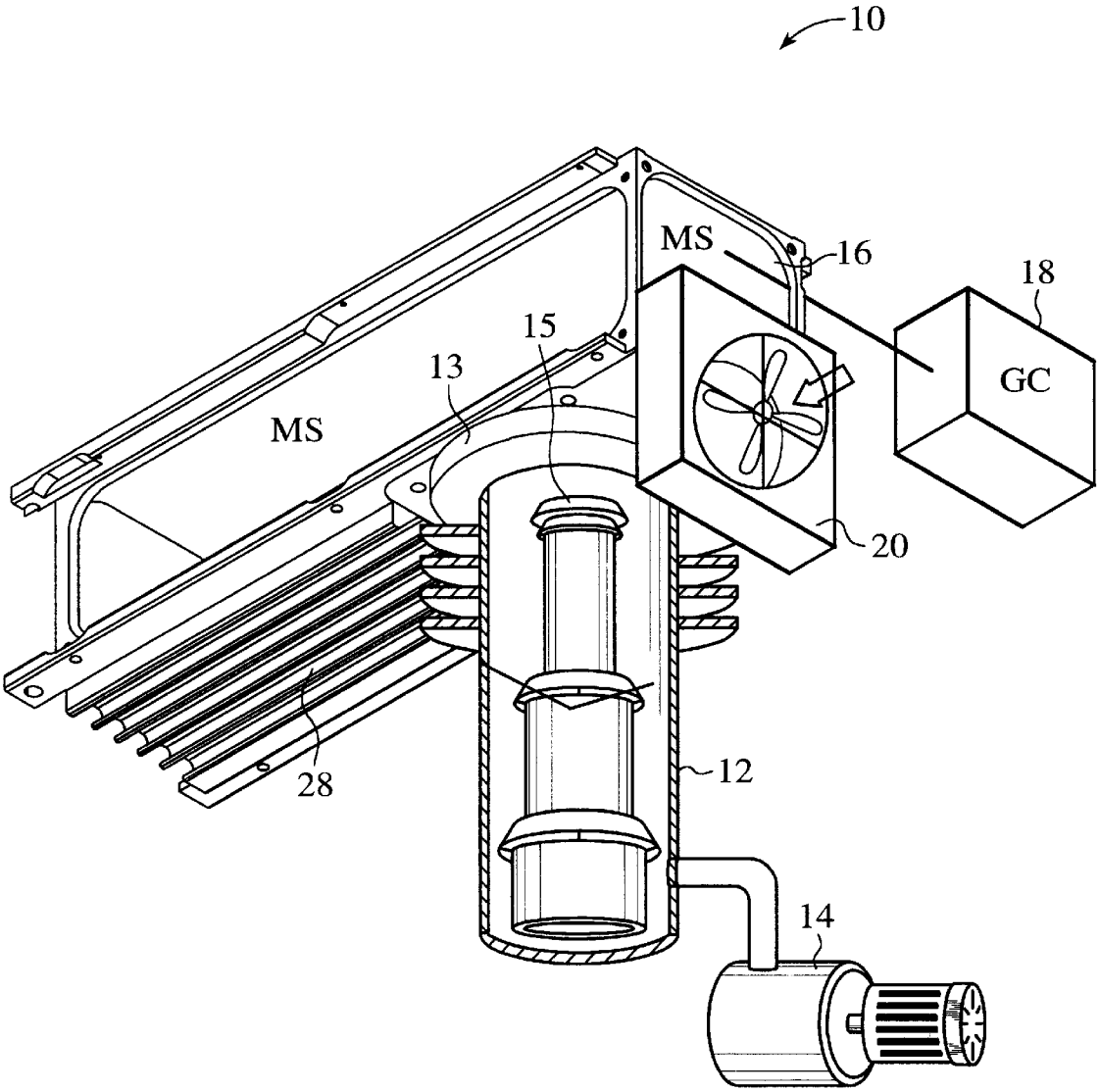
FIG. 1 is a schematical view of a vacuum system for gas chromatograph/mass spectrometry, with a diffusion pump being connected to an integral chamber housing and baffle in accordance with the invention.

With reference to FIG. 1, a vacuum system 10 is shown as including a diffusion pump 12 located between a rotary pump 14 and a housing 16 for defining a work environment that is to be evacuated. As will be explained below in detail, the housing 16 includes a vapor baffle that retards backstreaming of pumping vapor from the diffusion pump 12 into the work environment of the housing 16. The work environment may be a stand alone vacuum chamber or may be a vacuum chamber of a manifold, such as one used for gas chromatograph/mass spectrometry (GC/MS). Analytical equipment 18 for mass analysis is shown in FIG. 1. Also shown is a forced-air fan 20 that is used in the baffle cooling approach to be described below.

The operations of the components of the vacuum system 10 are known in the art. The rotary pump 14 may be used to remove the bulk of the gas from the vacuum chamber of housing 16. The diffusion pump 12 then provides further evacuation to reduce the chamber to a high-vacuum environment. A three-stage diffusion pump is illustrated, but this is not critical. An oil vapor diffusion pump vaporizes oil from a pool and forms supersonic umbrella streams that direct any gas molecules toward the lower region of the diffusion pump, so that the gas molecules are more easily removed by the rotary pump 14. One concern in the use of vacuum systems that include vapor diffusion pumps is that pumping vapor molecules will enter the vacuum chamber. Such backstreaming molecules will adversely affect the analytical process taking place within the housing 16. Consequently, a vapor baffle is utilized to provide an "optically opaque" flow path to the vacuum chamber. The vacuum system 10 may also include a cold cap 15 above the first stage element of the diffusion pump to further retard backstreaming. This is schematically indicated in FIG. 1.

Figure 2:
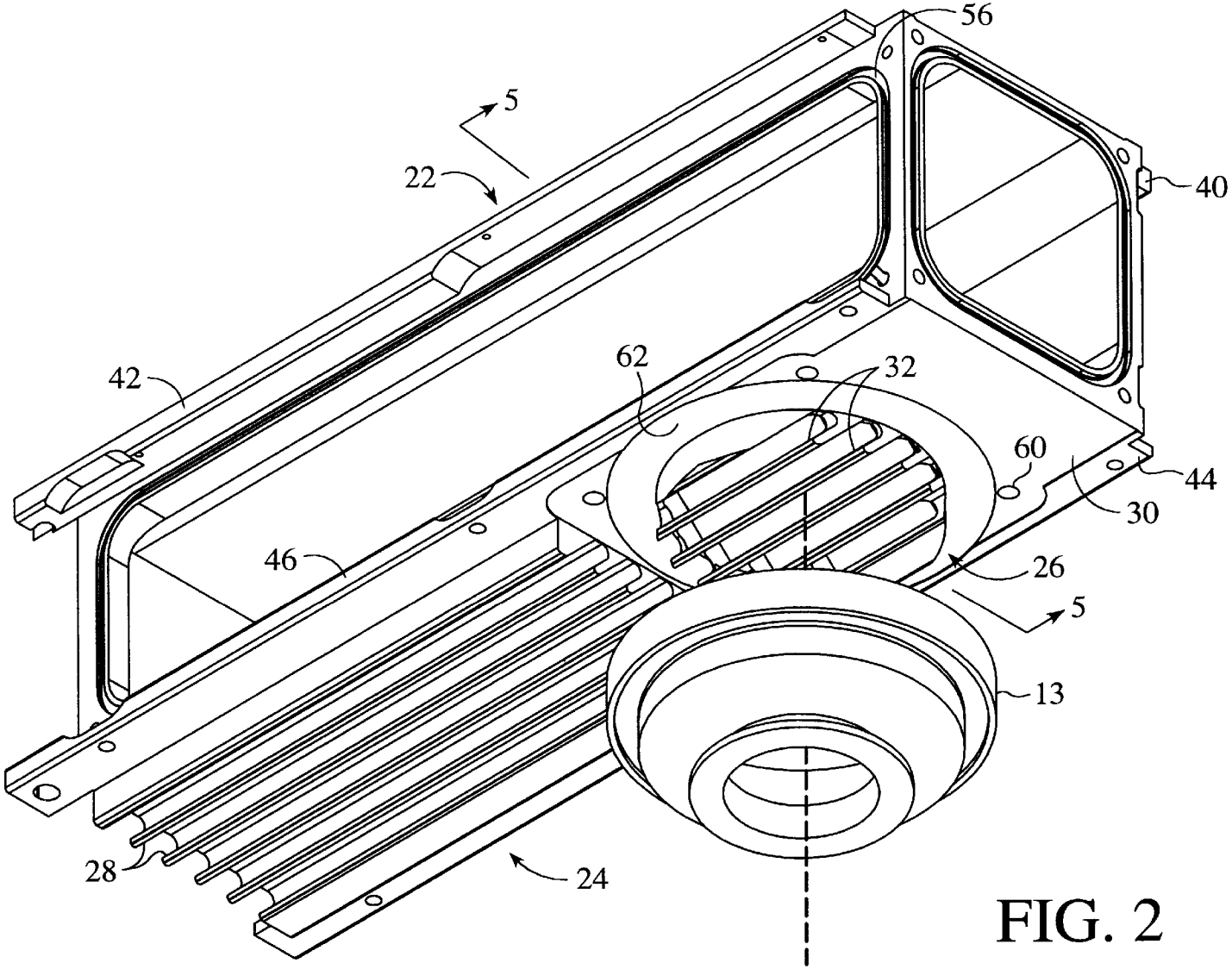
FIG. 2 is a perspective side view of one embodiment of a monolithic member for integrating the chamber housing and baffle according to the invention.

Referring now to FIG. 2, a monolithic member 22 substantially defines the shape of the work environment, i.e. vacuum chamber, of the housing 16 of FIG. 1. In the preferred embodiment, the monolithic member is metallic, so that the structure is thermally conductive. An acceptable metal for the single-piece structure is aluminum.

The monolithic member 22 is shown as being open ended and as having one open side. This facilitates the fabrication process, but is not critical to the invention. The monolithic member may have walls on all four lateral sides or may have more than one open side.

The lower side of the monolithic member 22 includes a wall region 24 and a baffle region 26. The monolithic member is shown in an inverted position in FIG. 3, so that the geometries of the wall and baffle regions are more evident. The wall region has a number of fins 28 that extend upwardly from a major exterior surface 30 of this side. The fins are integrally formed with the exterior surface 30. The fins significantly increase the surface area, thereby enhancing the cooling effect of a forced-air device, such as the fan 20 of FIG. 1. The baffle region 26 also includes an array of fins 32. The fins 28 of the wall region are convection cooling fins. On the other hand, the fins 32 of the baffle form the opposed surfaces of exterior channel portions of angularly contoured evacuation openings. The angle of the baffle fins 32 determines the angle of the exterior channel portions of the evacuation openings for removing gas from the interior of the vacuum chamber formed by the monolithic member.

Figure 4:
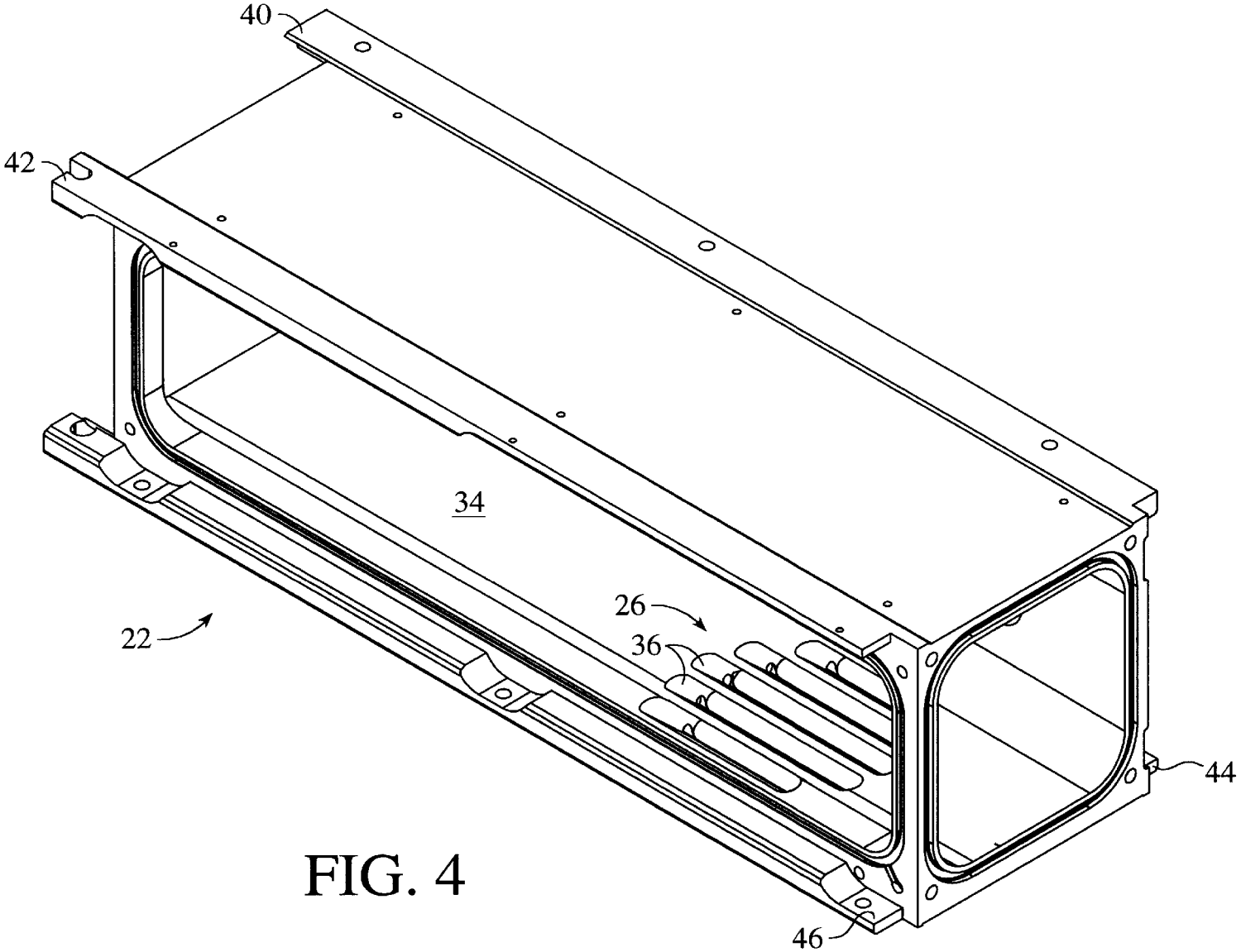
FIG. 4 is a perspective view of the monolithic member of FIG. 2, but looking downwardly into the interior of the monolithic member.
Figure 5:
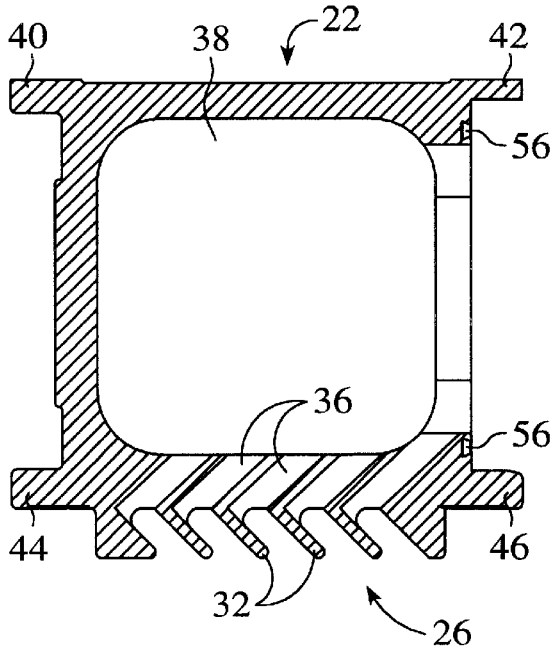
FIG. 5 is a cross sectional view of the monolithic member of FIG. 2, taken along lines 5—5.

Referring now to FIG. 4, the major interior surface 34 of the lower side may be seen. The wall region of this surface is planar, but the baffle region 26 includes an array of bores 36 that are at acute angles to the surface. The cross sectional view of FIG. 5 shows that the combination of spaced apart baffle fins 32 and the bores 36 establish a chevron configuration for the evacuation openings through the lower surface of the monolithic member. The chevron configuration assures that the baffle region is optically opaque. Thus, any backstreaming oil molecules from the diffusion pump will likely strike one of the surfaces of the evacuation openings. By sufficiently cooling the surfaces of the openings, condensation of the backstreaming material is promoted, so that the vacuum work environment 38 is less likely to be contaminated.

The angles of the interior channel portions and exterior channel portions are not critical. In one embodiment, the angle of the fins relative to the exterior major surface of the lower side and the angle of the bores 36 relative to the interior major surface of the lower side are both in the range of 40° to 60°. Angles of 47° are acceptable. The angles should be selected to ensure that the arrangement is optically opaque.

The upper and lower sides of the monolithic member 22 are extended in the widthwise dimension by rails 40, 42, 44 and 46. The rails are used in mounting the apparatus to other equipment. Including the rails, the monolithic member is approximately 14.3 cm. The height of the monolithic members is approximately 12.2 cm, while the length is approximately 43.2 cm. However, none of the dimensions is critical to the invention.

Returning to FIG. 3, an opening 48 in another side 50 of the monolithic member 22 provides an interface for introduction of a GC effluent. The GC equipment is connected to the monolithic member 22 using a conventional O-ring sealing port. The interface of the monolithic member must be formed to maintain the integrity of the high vacuum work environment. Other openings, not shown, in the housing 16 of FIG. 1 allow connections to a vacuum gauge and to instruments for mass analysis. However, the housing may be used in applications unrelated to GC/MS.

Figure 3:
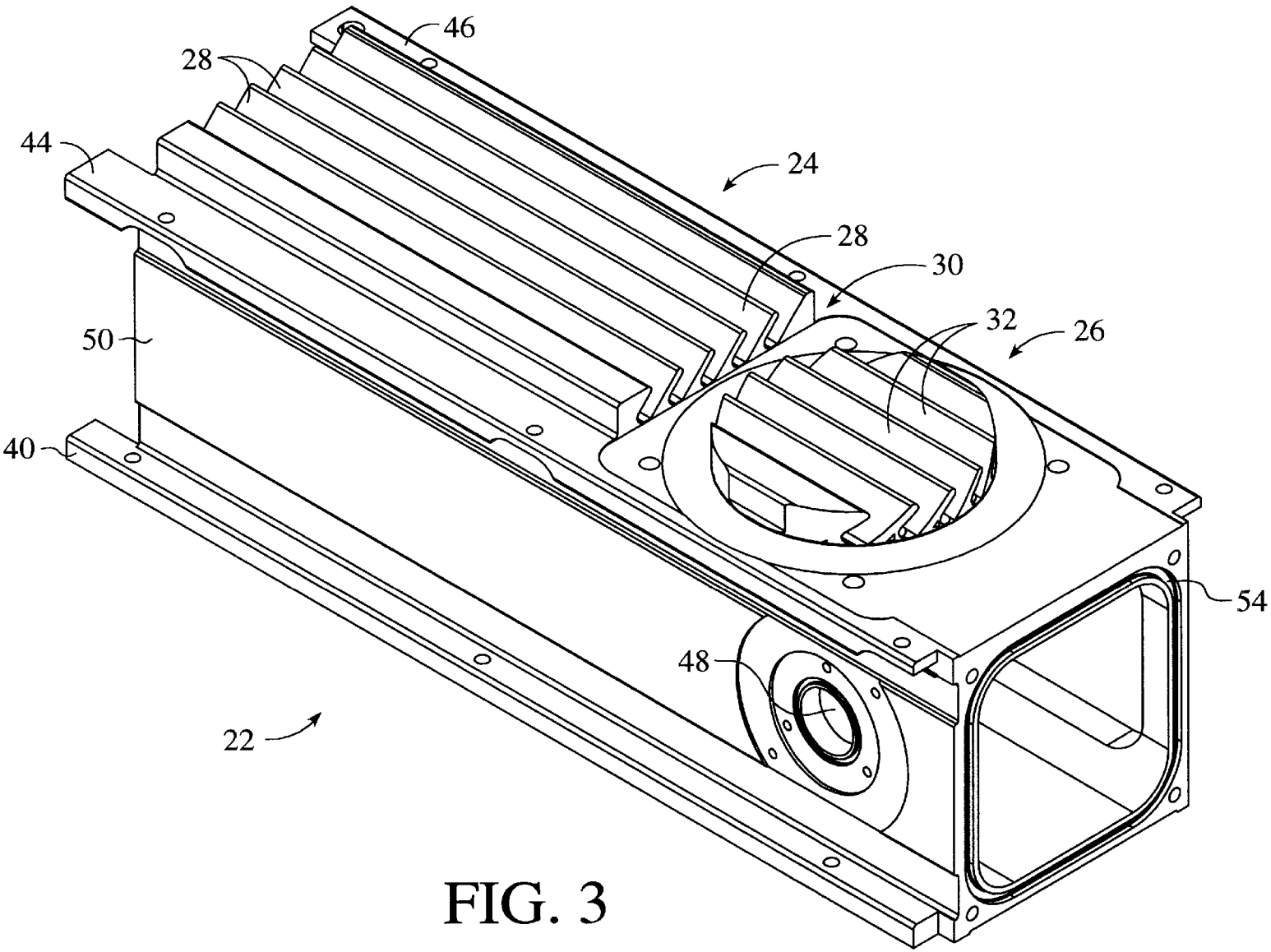
FIG. 3 is a perspective view of the monolithic member of FIG. 2 shown in an inverted position.

As previously noted, panels may be attached to one or both of the opposed ends and the open side to complete the housing that defines the high vacuum work environment. FIG. 3 shows that one end includes a groove 54 into which an elastomeric high vacuum seal is seated. Another high vacuum seal is received in a groove 56 at the open side of the monolithic member, as shown in FIGS. 2 and 5.

In operation, the diffusion pump 12 of FIG. 1 is connected to the lower side of the housing 16. The baffle region of the lower side is covered by the spool 13 that provides a liquid phase "drip back" return path for pumping liquid that is condensed at the baffle region. The spool is not a critical element of the invention, and in fact is preferably replaced by a direct connection to the uppermost neck of the vapor diffusion pump, forming a functional equivalent of the spool. One example of spool attachment is shown in FIG. 2, wherein the exterior surface 30 of the monolithic member 22 may include internally threaded holes 60 for mounting the spool. The spool itself is received within an O-ring sealing surface 62 and is held in place by clamps that are secured by bolts received within the internally threaded holes 60.

During operation of the diffusion pump 12, pumping vapor molecules that are directed toward the high vacuum work environment of the housing 16 from the diffusion pump are likely to contact one of the surfaces of the baffle region 26. The angularly contoured evacuation openings provide optical opacity that requires serpentine flow through the baffle region. If the surface that is contacted by a backstreaming vapor molecule is sufficiently cool, the vapor will condense, so that the work environment remains uncontaminated by the molecule. Since the surfaces of the evacuation opening are integral with the other features of the bottom side of the housing, there is an uninterrupted thermal conduction flow path from the baffle region to the remainder of the monolithic member 22. The efficiency of thermal energy transfer is further enhanced by providing the convection cooling fins 28 along the wall region 24. The increase in surface area allows a single forced-air cooling device, such as fan 20, to be used for the diffusion pump 12 and the vapor baffle.

As an alternative to or in combination with forced-air cooling, liquid cooling may be utilized. For example, water cooling tubes or lines may be connected to the rails 44 and 46 that are on opposite sides of the baffle region 26 of FIGS. 2–4. Liquid cooling of the monolithic member 22 in the area of the baffle would provide efficient heat-transfer conduction from the baffle region.

Within the exemplary GC/MS application of the invention, when the working environment of the housing 16 has reached a high vacuum condition through the combination of the rotary pump 14 and the diffusion pump 12, the GC/MS equipment 18 is used to execute an analytical process.

Figure 6:
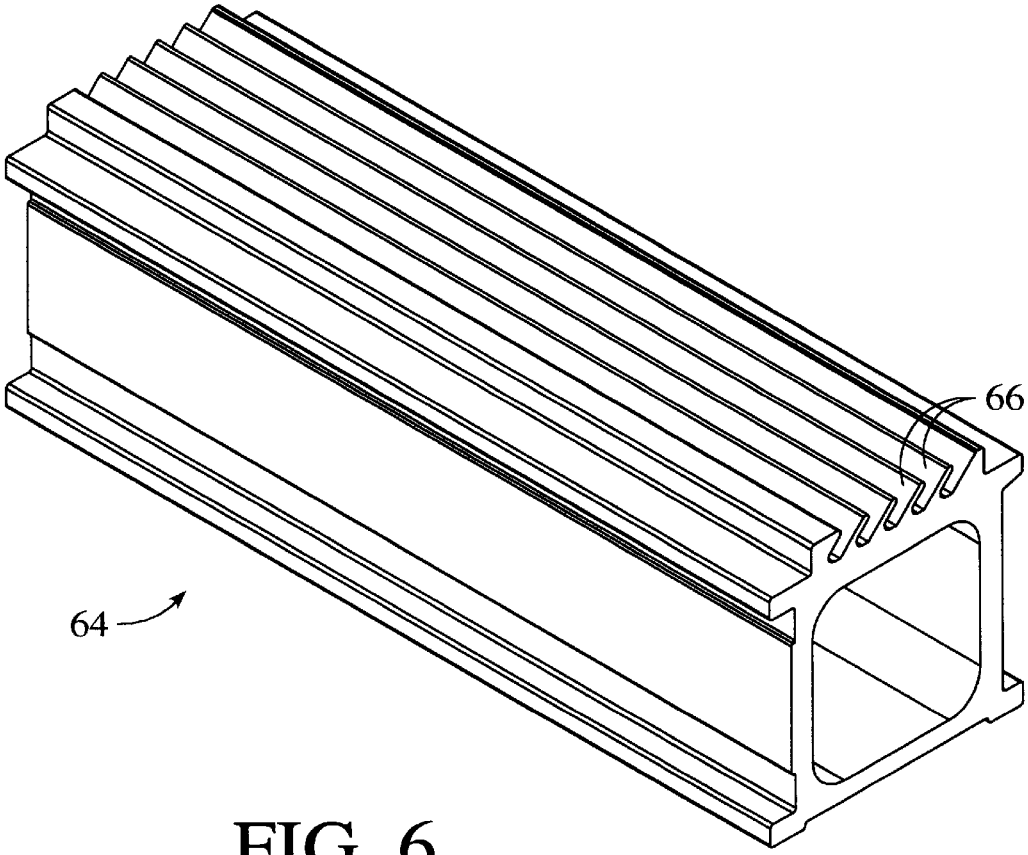
FIG. 6 is a perspective view of an extruded monolithic structure, prior to patterning to provide the structural features shown in FIGS. 2–5.

Referring now to the fabrication of the monolithic member, the process can include metal extrusion techniques. An appropriate die shape may be used to obtain the preliminary structure 64 shown in FIG. 6. The preliminary structure includes fins 66 that extend along the entire length of one side. One or more machining processes may then be used to segment the fins, forming the convection cooling fins 28 and the baffle fins 32 of FIGS. 2–5. The machining process or processes may include milling and/or electrochemical/electrical discharge machining. The same processing forms bores 36 that define the inner channel portions of the chevron evacuation openings. Also formed are the other structural features shown in FIGS. 2–5.

In a less preferred embodiment, the integration of the wall region 24 and the baffle region 26 is achieved by fabricating an isolated panel that is then connected to other panels to provide a high vacuum chamber or manifold. This embodiment provides the uninterrupted thermal transfer path from the baffle region to a region that can be air or water cooled. However, this embodiment requires additional high vacuum sealing.

I claim:

1. An apparatus for high vacuum applications comprising: housing means for generally defining a shape for a high vacuum work environment to be evacuated, said housing means having a plurality of sides, including a first side having a baffle region integral with a wall region, said baffle region having a plurality of angularly contoured evacuation openings therethrough for connection of said high vacuum work environment to a vacuum pump, said angularly contoured evacuation openings forming a zig-zag flow path from said high vacuum work environment via said baffle region that is integral with said wall region, said baffle region having a plurality of fins extending at acute angles relative to an exterior surface of said wall region of said first side, said fins being substantially parallel and being spaced apart to define first portions of said angularly contoured evacuation openings, wherein said wall region of said housing means exterior of the baffle region includes an array of cooling fins extending at acute angles from said exterior surface, each fin of said baffle region being aligned with one of said cooling fins of said wall region.

2. A vacuum system comprising:

a diffusion pump; and a housing for a vacuum chamber, said housing comprising a monolithic member, said monolithic member having a plurality of sides, including a first side that includes a baffle for providing fluid communication between said vacuum chamber and said diffusion pump, said baffle having chevron-shaped channels through said monolithic member to impede backstreaming of vapor into said vacuum chamber via said baffle; wherein said first side of said monolithic member is a wall having major interior and exterior surfaces, said baffle being a minor portion of said wall surface and said chevron-shaped channels being partially defined by parallel fins that extend integrally and outwardly at an acute angle from said major exterior surface, wherein said major exterior surface includes integral cooling fins that are a continuation of said fins that partially define said chevron-shaped channels, said monolithic member being a metallic member.

3. The system of claim 2 wherein said chevron-shaped channels are further defined by bores through said wall from said major exterior surface to said major interior surface, each bore being at an acute angle to said major interior surface.

4. The system of claim 2 further comprising means for providing forced air cooling over said cooling fins, thereby promoting thermal energy dissipation by means of conduction heat transfer from said baffle through said monolithic member to said cooling fins from which convection heat transfer of thermal energy occurs.

5. An apparatus for high vacuum applications comprising:

a monolithic housing defining a high-vacuum workspace;

a wall region having a baffle region formed in a planar side of the housing, the baffle region defining a plurality of angularly contoured openings in said wall region, the openings forming a zig-zag evacuation flow path out of the workspace;

a coupling region formed in the side of the housing adjacent the baffle region for coupling to a vacuum pump, and a plurality of cooling fins formed on the wall region of the housing exterior of the baffle region, wherein the angularly contoured openings are defined by slots extending through the baffle region of the planar side of the housing and by fins formed in the baffle region of the housing and parallel said slots and said cooling fins and extending from the planar side of the housing at acute angles thereto, whereby any heat generated by a vacuum pump coupled to the housing is dissipated through the wall region of the housing.

6. An apparatus as in claim 5 wherein the angularly contoured openings are chevron-shaped in cross-section.

7. An apparatus as in claim 6 wherein the angularly contoured openings are defined by slots extending at an acute angle from said wall region through the baffle region of the planar side of the housing.

8. An apparatus as in claim 5 wherein the coupling region comprises a spool for connecting a diffusion pump to the housing and for providing a gravity return path for condensed working fluid.

9. An apparatus as in claim 8 and further comprising a diffusion pump connected to the spool.

10. An apparatus as in claim 5 and further comprising means disposed in the high-vacuum workspace for performing mass spectrometry procedures therein.

* * * * *